US006501348B1

(12) United States Patent
Block et al.

(10) Patent No.: US 6,501,348 B1
(45) Date of Patent: Dec. 31, 2002

(54) METHOD FOR ADJUSTING THE FILTER CHARACTERISTIC OF A MICROWAVE CERAMIC FILTER

(75) Inventors: Christian Block, Stainz (AT); Hans-Werner Salz, Deutschlandsberg (AT)

(73) Assignee: Epcos Aktiengesellschaft, München (DE)

( * ) Notice: Subject to any disclaimer, the term of this patent is extended or adjusted under 35 U.S.C. 154(b) by 0 days.

(21) Appl. No.: 09/857,242

(22) PCT Filed: Dec. 3, 1999

(86) PCT No.: PCT/DE99/03888

§ 371 (c)(1),
(2), (4) Date: Jul. 12, 2001

(87) PCT Pub. No.: WO00/33412

PCT Pub. Date: Jun. 8, 2000

(30) Foreign Application Priority Data

Dec. 3, 1998 (DE) ..... 198 55 872

(51) Int. Cl.[7] ..... H01P 1/201

(52) U.S. Cl. ..... 333/202; 333/207

(58) Field of Search ..... 333/202, 207

(56) References Cited

U.S. PATENT DOCUMENTS

| | | |
|---|---|---|
| 5,146,193 A | 9/1992 | Sokola |
| 5,379,011 A | 1/1995 | Sokola et al. |

FOREIGN PATENT DOCUMENTS

| | | |
|---|---|---|
| DE | 196 28 023 | 8/1997 |
| EP | 0 743 696 | 11/1996 |

*Primary Examiner*—Don Phu Le
(74) *Attorney, Agent, or Firm*—Schiff Hardin & Waite

(57) ABSTRACT

Method for adjusting the filter characteristic of a microwave ceramic filter which has coupled ceramic resonators, that are ceramic resonators configured in a ceramic body, varies the distance between input/output connections and a grounding connection.

2 Claims, 2 Drawing Sheets

METHOD FOR ADJUSTING THE FILTER CHARACTERISTIC OF A MICROWAVE CERAMIC FILTER

BACKGROUND OF THE INVENTION

The present invention relates to a microwave ceramic filter having a ceramic body with at least two resonator bores and to a method for adjusting the filter characteristic of this filter.

Microwave ceramic filters are known from U.S. Pat. Nos. 5,146,193 and 5,369,011. These filters have a ceramic body with at least two resonator bores, which are coupled to one another via the ceramic body and which form ceramic resonators. The ceramic body is metallized all-around including the inside surface of the resonator bores, whereby input/output connections are formed on a surface by recesses or openings in the metallization.

Given a filter of the described species, it is further known from the cited printed patent specifications that the filter characteristic has at least one stop frequency, which can be influenced by the size of the recess surrounding the input/output connections.

In practical operation, it is frequently the case that users of HF filters, e.g. in the mobile radio telephone service, construct different heterogeneous receivers having different intermediate frequencies. This frequently forces the producers of such filters to short-term adapt the mirror suppression of the filter to the requirements of the customer or, in the most unfavorable case, to construct it for selective filters—predominantly multipolar filters—which are suitable for different attenuation requirements and which, however, are correspondingly complicated to produce and therefore expensive. Besides, microwave ceramic filters have the disadvantage that higher selectivity also conditions higher insertion attenuation.

SUMMARY OF THE INVENTION

An object of the present invention is to create a microwave ceramic filter of the relevant type, wherein the notch frequency can be shifted to the higher frequency edge of the filter characteristic, so that a better selection is obtained at the selected image frequency without the insertion attenuation suffering.

This object is achieved by a microwave ceramic filter having at least two ceramic resonators, which are coupled to one another and which are formed by resonator bores provided in a ceramic body and by an all-around metallization of the ceramic body and of the inside surfaces of the resonator bores, the metallization being partially left open for forming input/output connections and a ground or grounding connection, the improvement being a non-metallized strip extending from a first edge of the ceramic body to a second edge of the ceramic body, which is opposite the first edge, between the input/output connections and the grounding connection, and by a method for adjusting the filter characteristics of the microwave ceramic filter by adjusting a width of the non-metallized strip extending between the input/output connections and the ground connection from the first edge to the second edge. An advantageous further development of the invention includes an additional or further ground connection being provided between the input/output connections.

DESCRIPTION OF THE PREFERRED EMBODIMENTS

Figure 1:
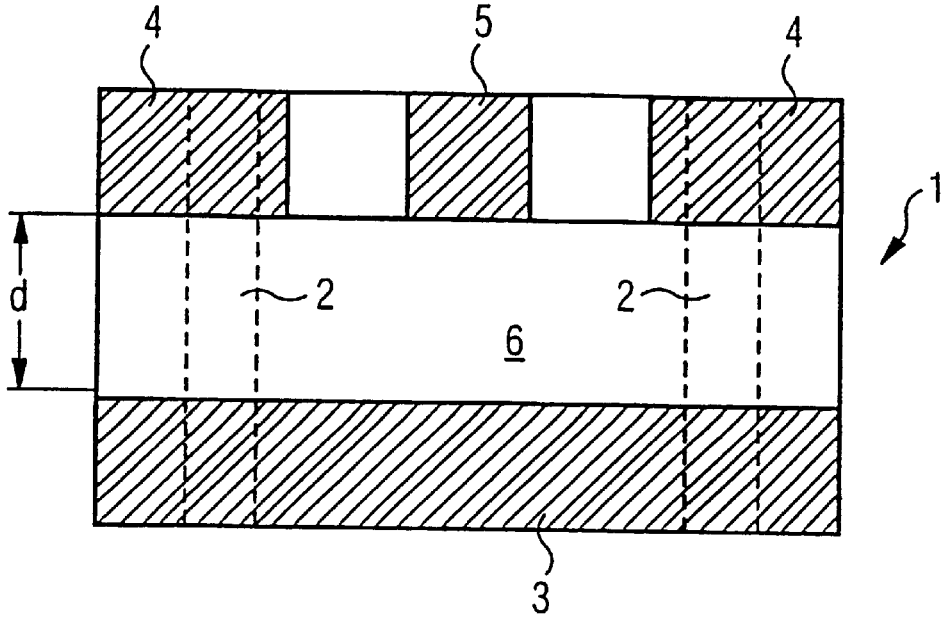
FIG. 1 is a front elevational view of the microwave ceramic filter.
Figure 2:
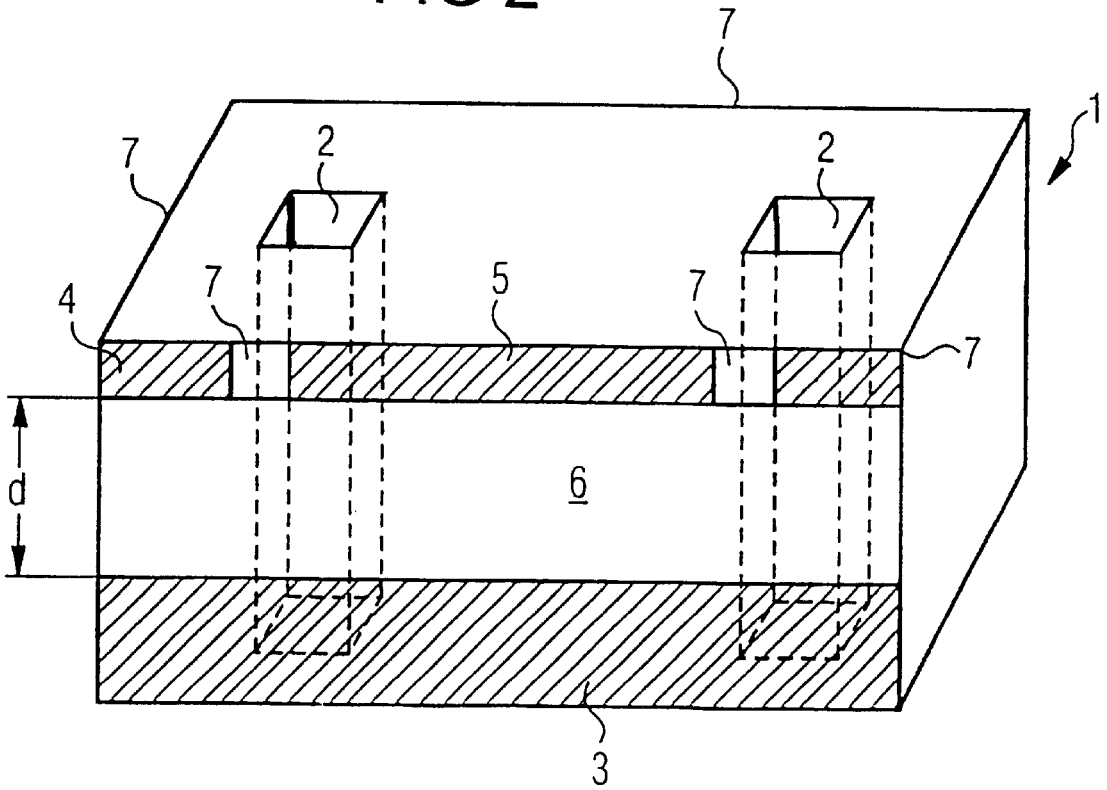
FIG. 2 is a perspective view of the filter.

FIGS. 1 and 2 of the drawing show a ceramic body 1 having two resonator bores 2 (shown in broken lines), and the number and shape of the resonator bores 2 are not restricted. Rather, n resonator bores 2 can be generally provided, whereby correspondingly many ceramic resonators are formed.

The ceramic body 1 is provided with metallizations 3, 4 and 5 (shown in shaded lines), whereby the metallizations 4 forms two input/output connections and the metallization 3 forms a ground or grounding connection. A further or additional ground or grounding connection 5 can be arranged between the input/output connections 4. This connection 5 also reduces an undesired coupling between the input/output connections.

A metallization-free zone 6, which continuously extends from a first edge of the ceramic body 1 to a second edge opposite of the first edge, is provided for galvanically separating the input/output connections 4 and potentially the grounding connection 5 from the other metallization of the ceramic body 1. All other surfaces are metallized apart from the surfaces 7.

Given a modification of the galvanic separation (referred to as d) between the input/output connections 4 and the grounding connection 3, the rectangular waveguide mode of a microstrip, which is expansion-capable with respect to higher frequencies and which is composed of two $\lambda/4$ line resonators that are coupled to one another, is modified such that the notch frequency can be shifted on the higher frequency edge of the filter characteristic, whereby a better selection is present at the selected image frequency without the insertion attention suffering.

Figure 3:
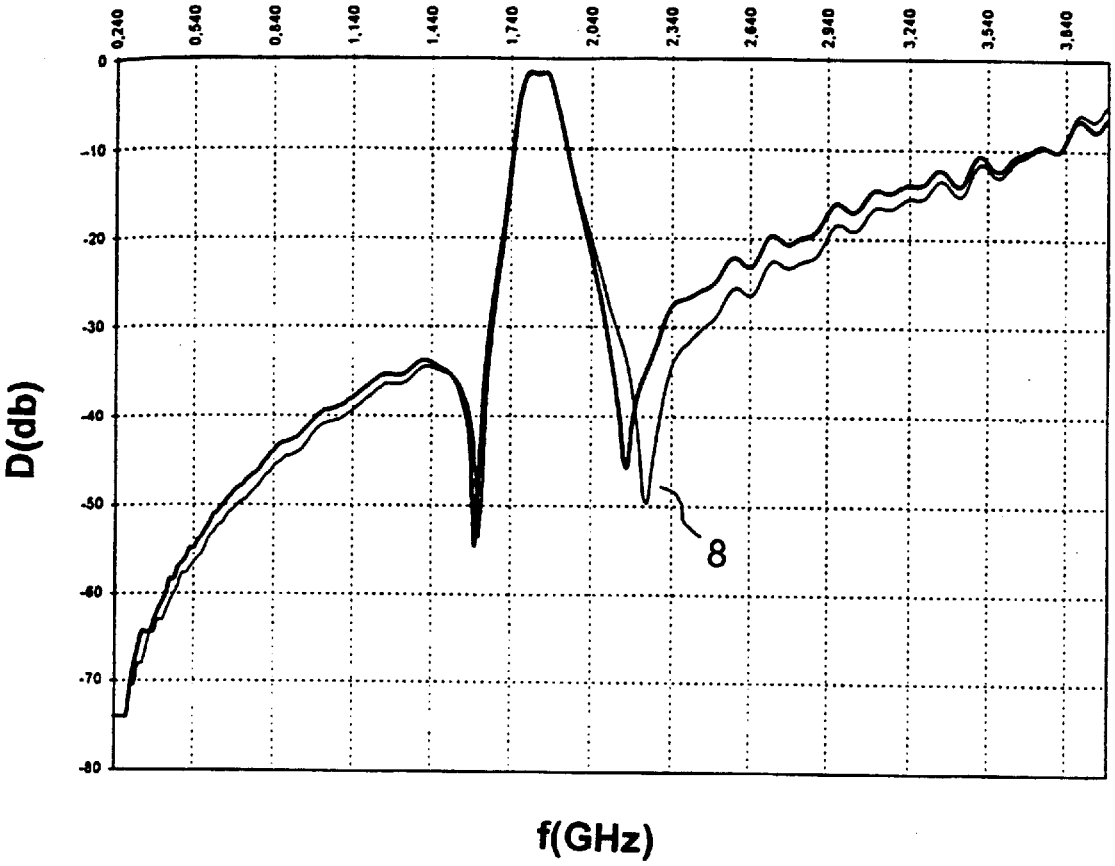
FIG. 3 is a diagram showing filter characteristics of attenuation D for frequencies f for two different widths of a non-metallized strip.

FIG. 3 shows a typical filter characteristic of an inventive filter. The attenuation D is applied against the frequency f for two filters of different widths d for the non-metallized strip. The position of the minimum 8 of the attenuation can be particularly adjusted by changing the width d of the non-metallized strip.

Since this galvanic separation is adjusted on the side which has the connections 4 and 5 of the filter and is the soldering side, this filter is more stable vis-a-vis filters having structures or metallization-free areas on the surface and are loaded by potential shieldings, for example.

The filter characteristic can be application-specifically and device specifically adjusted in that the inventive galvanic separation width d is fixed once. In addition to the advantage of the best possible selection, the user has the advantage that the loss attenuation can be simultaneously kept at a minimum.

We claim:

1. Method for adjusting the filter characteristic of a microwave ceramic filter having at least two ceramic resonators, which are coupled to one another and which are formed by resonator bores provided in a ceramic body and by an all-around metallization of the ceramic body and of the inside surfaces of the resonator bores, the metallization being partially left open for forming input/output connections and a grounding connection, said filter having a non-metallized strip extending from a first edge of the ceramic body to a second edge of the ceramic body, which is opposite the first edge, and between the input/output connections and the grounding connection, the method adjusting the filter characteristic by adjusting the width (d) of said strip.

2. Method according to claim 1, wherein the ceramic filter has a further grounding connection between the input/output connections.

* * * * *